US006007373A

United States Patent [19]

Chew

[11] Patent Number: 6,007,373

[45] Date of Patent: Dec. 28, 1999

[54] APPARATUSES AND METHODS FOR COUPLING DC POWER TOOLS TO EXTERNAL DC POWER SOURCES

[76] Inventor: William E. Chew, 3550 W. Augusta Ave., Phoenix, Ariz. 85051

[21] Appl. No.: 09/083,825

[22] Filed: May 22, 1998

[51] Int. Cl.[6] ..... H01R 11/00

[52] U.S. Cl. ..... 439/504; 439/500

[58] Field of Search ..... 439/504, 502, 439/505, 621, 622, 500

[56] References Cited

U.S. PATENT DOCUMENTS

| | | | |
|---|---|---|---|
| 2,748,359 | 5/1956 | Swan | 439/502 |
| 3,466,453 | 9/1969 | Greenberg | 439/504 |
| 4,310,874 | 1/1982 | Spiteri | 439/502 |
| 4,835,410 | 5/1989 | Bhagwat et al. | 307/64 |
| 4,936,796 | 6/1990 | Anderson, Jr. | 439/620 |
| 4,946,396 | 8/1990 | Saitoh | 439/500 |
| 4,988,584 | 1/1991 | Shaper | 429/50 |
| 5,076,805 | 12/1991 | Welch | 439/568 |
| 5,395,264 | 3/1995 | Keith | 439/502 |
| 5,599,204 | 2/1997 | Glassford | 439/502 |
| 5,715,156 | 2/1998 | Yilmaz et al. | 363/142 |

*Primary Examiner*—Steven L. Stephan
*Assistant Examiner*—T C Patel
*Attorney, Agent, or Firm*—Steven Lin

[57] ABSTRACT

Apparatus 10 uses presently existing, conventional extension cord(s) 40 to couple a power tool 20, which normally operates using an internal direct current power source (i.e. battery cartridge), to an external direct current power source 90. The apparatus 10 has a power tool adapter or coupler 30 that couples to the power tool 20 and that further couples to a plug end of the extension cord(s) 40. The apparatus 10 also has an external source adapter or coupler 50 that couples to the other plug end of the extension cord(s) 40 and that further couples to the external direct current power source 90. The power tool adapter or coupler 30 has a tool adapter housing/casing 32 or battery cartridge housing/casing 32 that is conformed to slidingly insert, fit, and couple into a power source receptacle 22 of the power tool 20. A safety trip mechanism or fuse 70 is integrated into the power tool adapter or coupler 30 to prevent damage and injury when a power overload or surge occurs. The power tool adapter or coupler 30 has an extension attaching component 36A, 36B, 37A, or 37B that couples to a plug end of the extension cord(s) 40. The external source adapter or coupler 50 has an extension coupling component 54A, 54B, 55A, or 55B that couples to the other plug end of the extension cord(s) 40. A safety trip mechanism 60 is integrated into the external source adapter or coupler 50 to also prevent damage and injury when a power overload or surge occurs. The external power source contacts 58 and 59 of the external source adapter or coupler 50 couple to terminals 98 and 99 of the external direct current power source 90. The external source adapter/coupler 50 further has a voltage regulator circuit 80 to regulate and control voltage from the external direct current power source 90 to the power tool 20.

18 Claims, 6 Drawing Sheets

APPARATUSES AND METHODS FOR COUPLING DC POWER TOOLS TO EXTERNAL DC POWER SOURCES

FIELD OF INVENTION

The present invention relates to coupling a power tool to an external power source, and, in particular, to apparatuses and methods for coupling a direct current (DC) power tool that is normally operated by its own internal DC power source to an external DC power sources.

BACKGROUND OF INVENTION

One problem that exists with cordless DC battery powered tools is the limited amount of charge that is able to be maintained and stored by its battery cartridge before it must be recharged. The confined amount of charge limits the amount of time that the power tool may perform until the cartridge needs to be recharged or replaced. Cordless power tools are often used in situations where an external alternating current (AC) power source is not immediately available for conventional AC power tools to be used. Many "on the job"or remote sites lack electrical service completely, thus making it impossible to use conventional AC power tools or to recharge the battery cartridges of cordless DC power tools Devices that allow cordless DC power tools to be operated from an external DC power source (i.e. other than its own conventional DC power source/battery cartridge) have been developed. See, e.g., U.S. Pat. Nos. 5,076,805; 4,835,410; and 5,715,156. These devices generally comprise an adapter or insert with contacts that generally insert into the area where the battery cartridge would normally be inserted. The contacts of the adapter or insert are coupled to the power contacts of the power tool. External power source couplers are provided for coupling the power tool to an external DC power source, and a cord of fixed length coupled between the adapter or insert and the external power source coupler provides user length or distance between the power tool and the external power source. However, a major problem with the provided cord is that it is fixed in length and cannot or is not able to be readily adjusted or varied to a generally desired or convenient length.

Therefore, the need exists for devices and methods that allow cordless DC power tools to be operated from an external DC power source (i.e. other than its own conventional DC power source/battery cartridge) wherein the devices and methods allows coupling of the DC power tool to an external DC power source and allows the cord or cords between the adapter or insert and external power source coupler to be more easily or conveniently adjusted or varied to a generally desired or preferred length for the user.

SUMMARY OF THE INVENTION

It is an object of the invention to provide improved devices and methods for coupling cordless DC power tool(s) to an external DC power source(s) (i.e. other than its own conventional DC power source/battery cartridge).

It is a further object of the invention to provide the devices and methods for coupling the DC power tool(s) to external DC power source(s) and allow the cord or cords coupling between the power tool(s) and the external DC power source(s) to be more easily or conveniently adjusted or varied to a generally desired or preferred length for the user.

It is another object of the invention to provide the devices and methods for coupling the DC power tool(s) to an external DC power source(s) which utilize a desired or preferred number of presently existing, conventional extension cord or cords.

It is another object of the invention to provide the devices and methods that couples the power tool(s) to an external power source(s) using a multiple number of presently existing, conventional extension cords coupled together and that couples together a desired or preferred number of presently existing, conventional extension cord or cords.

It is another object of the invention to use extension cords that are readily available in various lengths and are able to be combined to create any length to allow the power tool(s) to be operated at a considerable distance from the external DC power source(s).

It is still another object of the invention to use extension cords that allow the cords of the present invention to be able to be kept to a minimal, providing a less cumbersome length of cord for the coupling components of the present invention which the user handles.

It is still a further object of the invention to not have to manufacture specialized cords for the present invention.

It is a further object of the invention to provide the devices and methods that easily couple the power tool contacts to an end of an extension cord and to further couple the power contacts of an external power source to another end of an extension cord.

It is still a further object of the invention to provide the devices and methods that couple the positive power tool contact with the positive external power source contact and the negative power tool contact with the negative external power source contact.

It is still another object of the invention to provide the devices and methods that couple the power tool(s) to an external power source(s) and prevent power overloads/surges from damaging the present invention and the power tool and from injuring the user.

It is still another object of the invention to provide the devices and methods that couple the power tool(s) to an external power source(s) and prevent the present devices from being accidentally inserted into inappropriate plug receptacles.

It is a further object of the invention to provide the devices and methods that couple the power tool(s) to an external power source(s) and regulate and control the voltage from the external power source.

The above and other objects are achieved by an apparatus for using at least one extension cord to couple a power tool having power tool contacts, which normally couple to an internal direct current power source for normal operations of the power tool, to an external direct current power source. The apparatus has a power tool adapter having power coupling contacts that are able to correspondingly couple to the power tool contacts, and the power coupling contacts further have an extension attaching component with contacts that are coupled to the power coupling contacts and that are adapted to receive and couple to contacts at a plug end of the extension cord(s). Furthermore, the apparatus has an external source adapter having an extension coupling component with contacts adapted to receive and couple to contacts at another plug end of the extension cord(s) and having external power source contacts coupled to the contacts of the extension coupling component and adapted to couple to the external direct current power source. The power tool adapter has a tool adapter housing or battery cartridge housing that generally holds the power coupling contacts and to which the extension attaching component is attached and that is conformed to slidingly insert into a power source receptacle of the power tool.

A safety trip mechanism is coupled between the power coupling contacts and the extension attaching component to prevent damage to the power tool adapter and the power tool in an event of a power overload or surge applied through the extension attaching component. The external source adapter further has an external source adapter housing that generally holds the extension coupling component and to which an end of the external power source contacts are attached wherein the housing has at least one access area for allowing the extension coupling component to be accessed to couple to the another plug end of the at least one extension cord and another at least one access area through which the external power source contacts are able to couple between the extension coupling component and the external direct current power source. A safety trip mechanism is coupled between the extension coupling component and the external power source contacts to prevent damage to the extension coupling component and the power tool in an event of a power overload/surge from the at least one extension cord. The extension coupling component further has a guard component surrounding the plug component to guard the plug from being accidentally inserted into inappropriate plug receptacles. The external power source contacts are alligator clips for coupling to terminals of the external direct current power source. The external source adapter further has a voltage regulator circuit to regulate and control voltage from the external direct current power source.

The above and other objects are also achieved by an apparatus for coupling a power tool, which normally couples to an internal direct current power source for normal operations of the power tool, to an external direct current power source. The apparatus has at least one extension cord for coupling the power tool to the external direct current power source, a power tool to extension cord coupler that attaches to the power tool and to a plug end of at least one extension cord, and an extension cord to external power source coupler that attaches to another end of the at least one extension cord and to the external direct current power source.

The above and other objects are further achieved by a method of coupling a power tool that normally operates by an internal direct current power source to an external direct current power source. The method comprises the acts of coupling contacts of the power tool to contacts of a power tool coupling device, coupling the contacts of the power tool coupling device to an extension cord coupler, coupling the extension cord coupler to a plug end of at least one extension cord, coupling another plug end of the at least one extension cord to contacts of an external power source coupling device, coupling the contacts of the external power source coupling device to external power source couplers, and coupling the external power source couplers to the external direct current power source.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for"or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
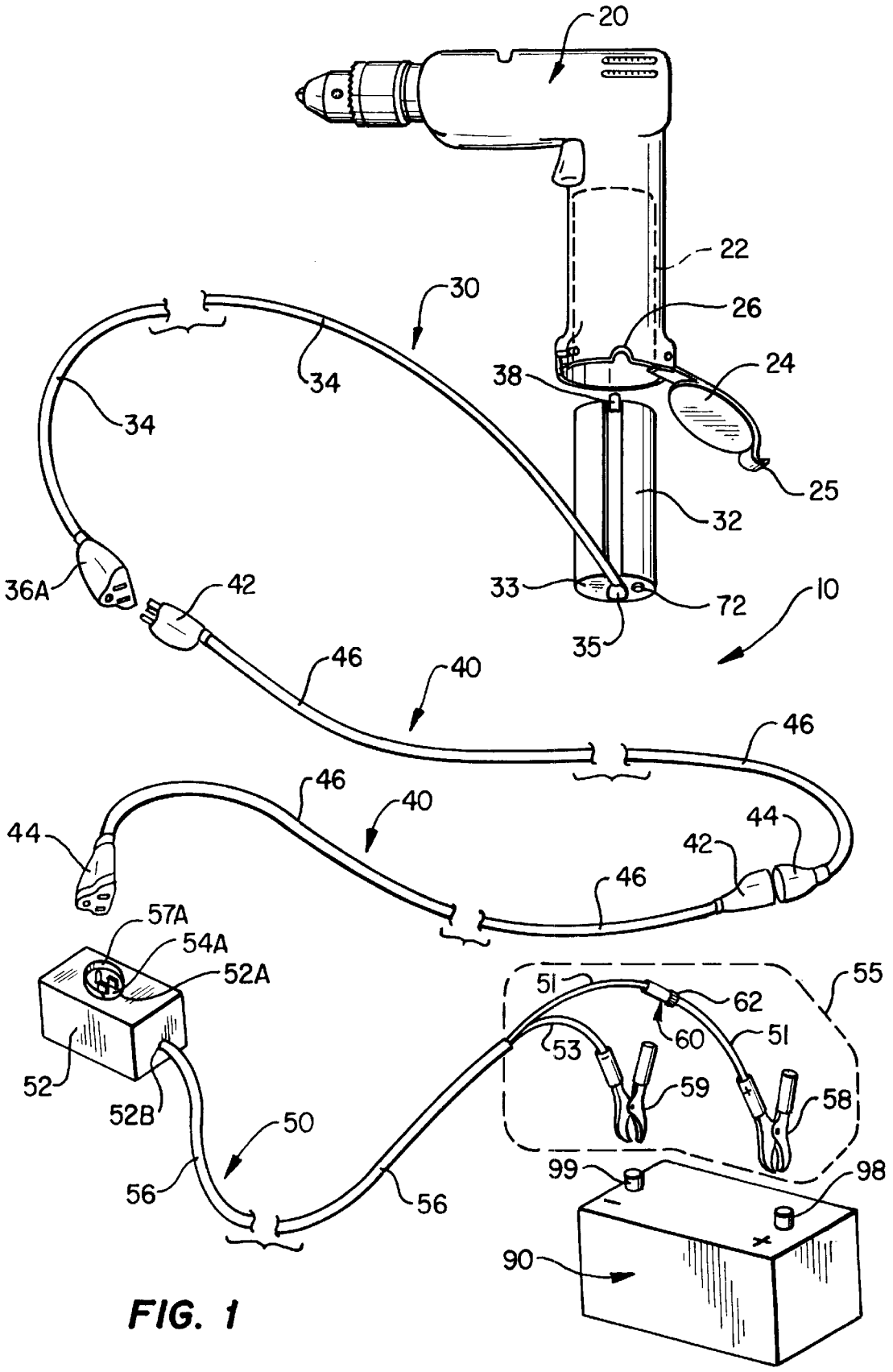
FIG. 1 is an over view of a first embodiment of the present invention apparatus for using at least one extension cord to couple a power tool having power tool contacts, which normally couple to an internal direct current power source for normal operations of the power tool, to an external direct current power source.

The present invention discloses an apparatus 10 that couples a power tool 20 (i.e. including but not limited to direct current (DC) power drills, saws, sanders, blowers, etc.) having power tool contacts 28 and 29 respectively to terminals 98 and 99 of an external direct current power source 90 (power sources 90 include but are not limited to automobile, motorcycle, marine, vehicle, and other DC battery sources). Power tool contacts 28 and 29 respectively couple to the contacts of an internal direct current power source (i.e. battery cartridge, which is not shown) for normal operations of the power tool 20. The present invention uses conventional or presently existing extension cord(s) 40 in accomplishing the task of coupling the power tool 20 to the external direct current power source 90. The cords 40 are readily available in various lengths and are able to be combined to create any length to allow the power tool 20 to be operated at a considerable distance from the external DC power source 90. The use of extension cords 40 allows the cords of the present invention to be able to be kept to a minimal, providing a less cumbersome length of cord for the coupling components of the present invention which the user handles. Furthermore, specialized cords do not have to be manufactured for the present invention.

The present invention, therefore, discloses the apparatus 10 for coupling a power tool 20, which normally couples to an internal direct current power source for normal operations of the power tool, to an external direct current power source 90. The apparatus 10 generally comprises the use of at least one extension cord 40 for coupling the power tool 20 to the external direct current power source 90. The apparatus 10 also generally has a power tool to extension cord coupler that attaches or couples to the power tool 20 and to a plug end of the at least one extension cord 40 and an extension cord to external power source coupler that attaches or couples to another end of the at least one extension cord 40 and to the external direct current power source 90.

FIGS. 1 to 6 disclose a first preferred embodiment of the present invention 10 while FIGS. 7 to 12 disclose a second preferred embodiment of the present invention 10. The first embodiment is identical to the second embodiment except that the extension cord female/male coupling plug portions for the first embodiment are reversed for the second embodiment. Therefore, these two embodiments will be discussed together below.

Figure 2:
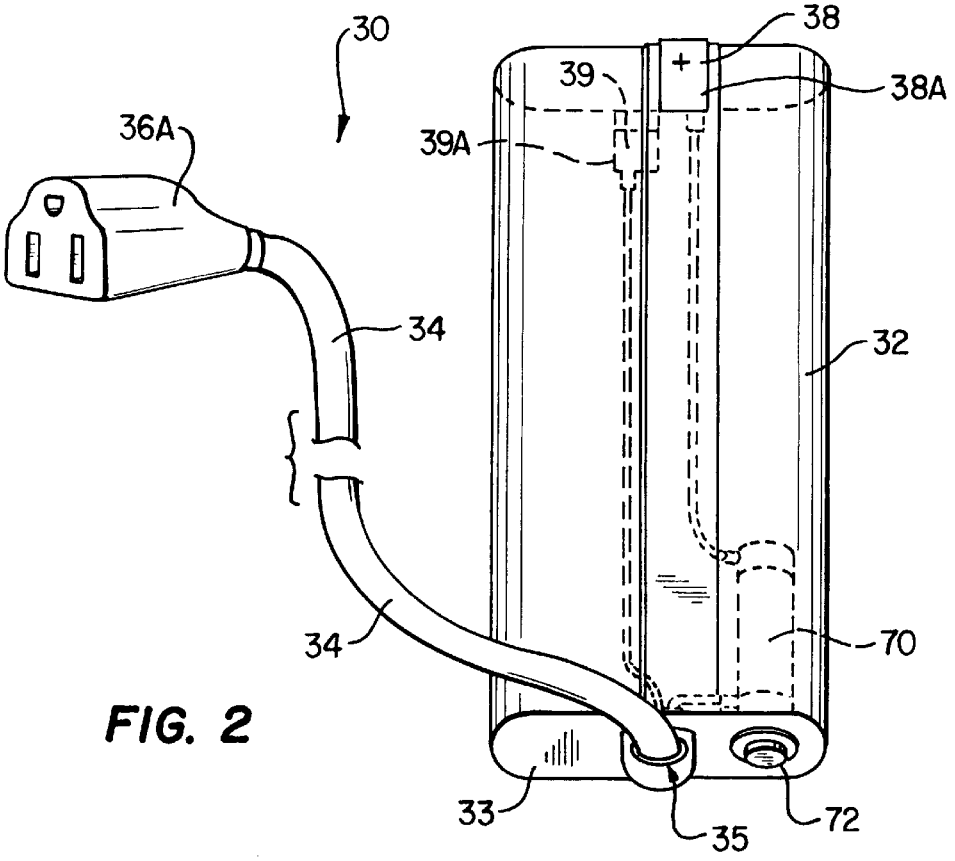
FIG. 2 is a side view of the power tool adapter for the first embodiment apparatus showing a cord and a type of extension attaching component with contacts that are adapted to receive and couple to contacts at a plug end of the extension cord(s).
Figure 7:
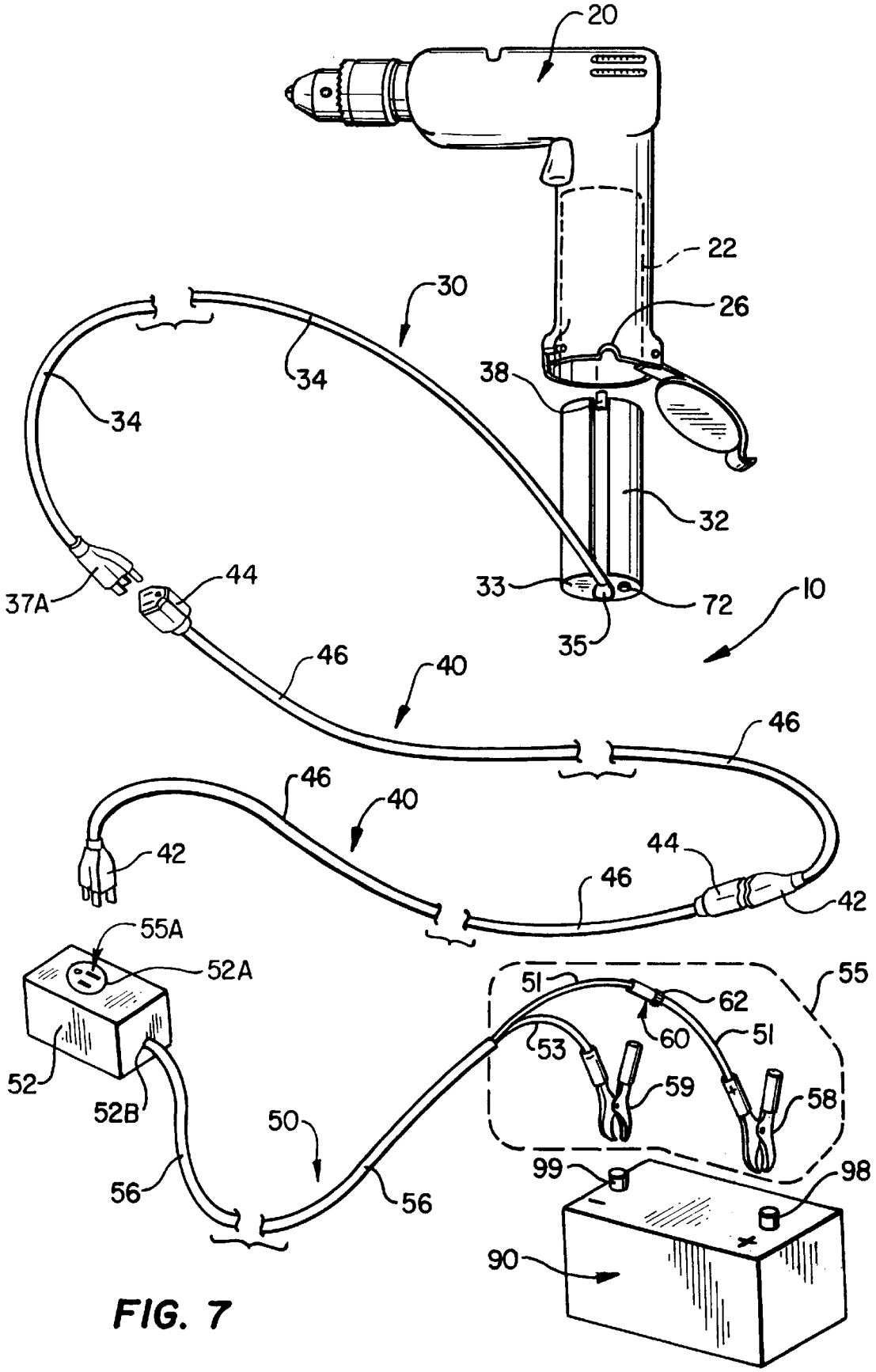
FIG. 7 is an over view of a second embodiment of the present invention apparatus for using at least one extension cord to couple a power tool having power tool contacts, which normally couple to an internal direct current power source for normal operations of the power tool, to an external direct current power source.
Figure 8:
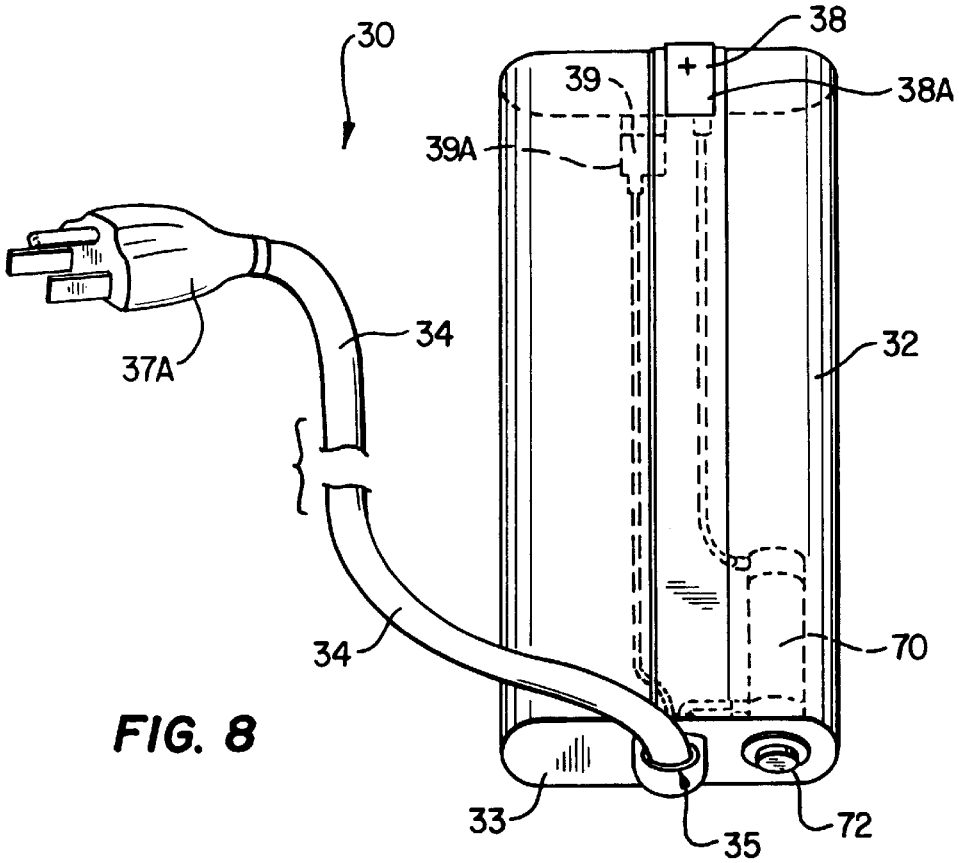
FIG. 8 is a side view of the power tool adapter for the second embodiment apparatus showing a cord and a type of extension attaching component with contacts that are adapted to receive and couple to contacts at a plug end of the extension cord(s).

Referring to FIGS. 1 and 7, the present invention apparatus 10 has a power tool adapter 30 or power tool to extension cord coupler 30 and an external source adapter 50 or extension cord to external power source coupler 50. The power tool adapter or coupler 30 has a tool adapter housing or casing 32, and the housing 32 generally holds the power coupling contacts 38 and 39 (which may be expose metallic contact leads). The power coupling contacts 38 and 39 respectively contact and couple to the contacts 28 and 29 of the power tool 20. FIGS. 1 to 3 and 7 to 10 shows that the tool adapter housing 32 is shaped as or similar to a battery cartridge housing. The housing 32 is able to slidingly and securely insert or fit into a battery cartridge receptacle or power source receptacle 22 of the power tool 20 (i.e. the receptacle 22 is normally where the internal battery cartridge is received). In FIGS. 2 and 8, the housing 32 has access or open areas 38A and 39A through which the power coupling contacts 38 and 39 are respectively exposed to be able to respectively couple to the power tool contacts 28 and 29. The housing 32 also has another access or open area 35 through which the first embodiment extension attaching component 36A or 36B or the second embodiment extension attaching component 37A or 37B is able to respectively couple to the plug end 42 or 44 of the extension cord(s). These extension attaching components 36A, 36B, 37A, or 37B are adapted to receive and couple to the contacts of the plug end 42 or 44.

Figure 4:
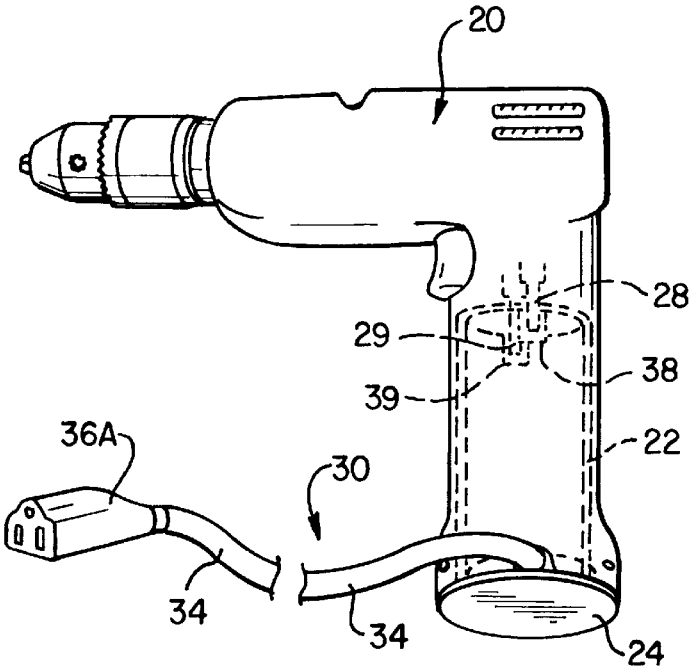
FIG. 4 is a side view of the power tool adapter for the first embodiment apparatus of FIG. 2 inserted and coupled to the power tool.
Figure 10:
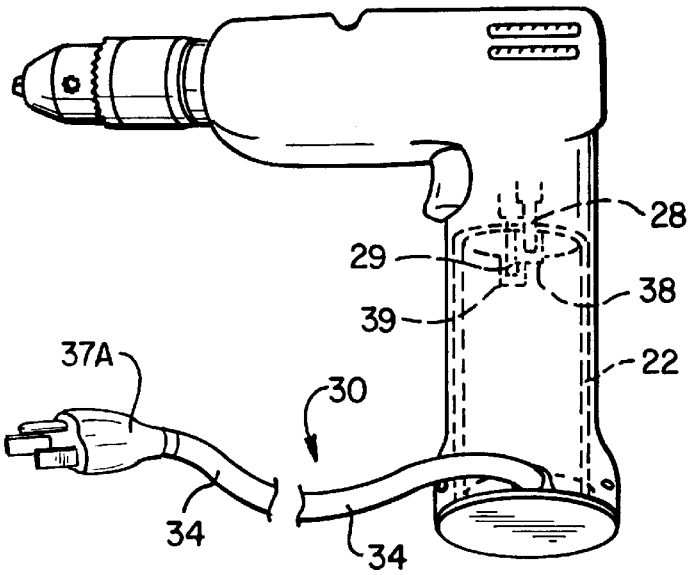
FIG. 10 is a side view of the power tool adapter for the second embodiment apparatus of FIG. 8 inserted and coupled to the power tool.

In FIGS. 1 and 2 or FIGS. 7 and 8, the one type of extension attaching component 36A and 37A of the power tool adapter 30 shows the use of at least one cord 34 coupled between the power coupling contacts 38 and 39 and the extension attaching component 36A or 37A. The cord 34 extends through an access or open area 35 from a bottom portion 33 of the power tool adapter 30. After the battery cartridge housing 32 of power tool adapter or coupler 30 is inserted into the receptacle 22 of power tool 20, the cord 34 is placed into the curved cord receiving portion 26 of the power tool 20, and the battery receptacle door 24 is then closed and secured or locked by lock engaging component 25 that is attached to the door 24 engaging to a receiving portion at the bottom of the power tool 20. The cord 34 neatly extends from between the cord receiving portion 26 and the door 24. The cord 34, however, may also extend from the housing 32 and the receptacle 22 in any other suitable manner using any other suitable configurations. FIGS. 1, 2, and 4 show that the extension attaching component 36A is a female plug 36A with receiving contacts that receive a male plug 42 from an extension cord 40 while FIGS. 7, 8, and 10 show that the extension attaching component 37A is a male plug 37A with inserting contacts that insert into a female plug 44 of an extension cord 40.

Figure 3:
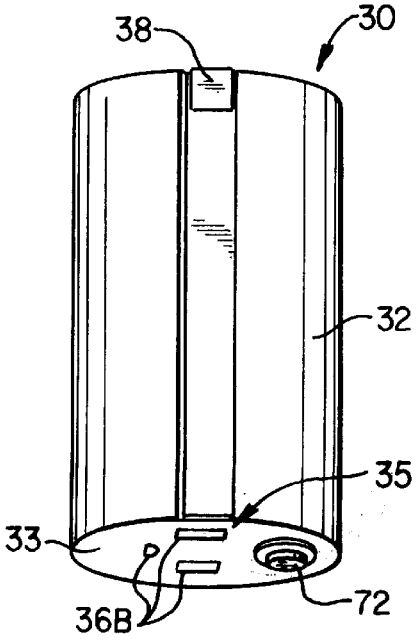
FIG. 3 is a side view of the power tool adapter for the first embodiment apparatus showing another type of extension attaching component with contacts that are adapted to receive and couple to contacts at a plug end of the extension cord(s).
Figure 9:
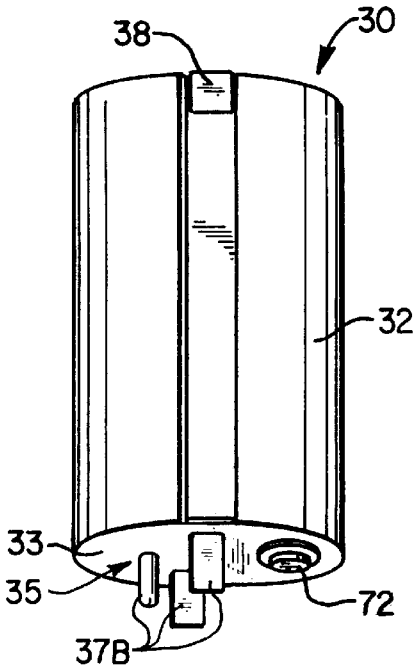
FIG. 9 is a side view of the power tool adapter for the second embodiment apparatus showing another type of extension attaching component with contacts that are adapted to receive and couple to contacts at a plug end of the extension cord(s).
Figure 11:
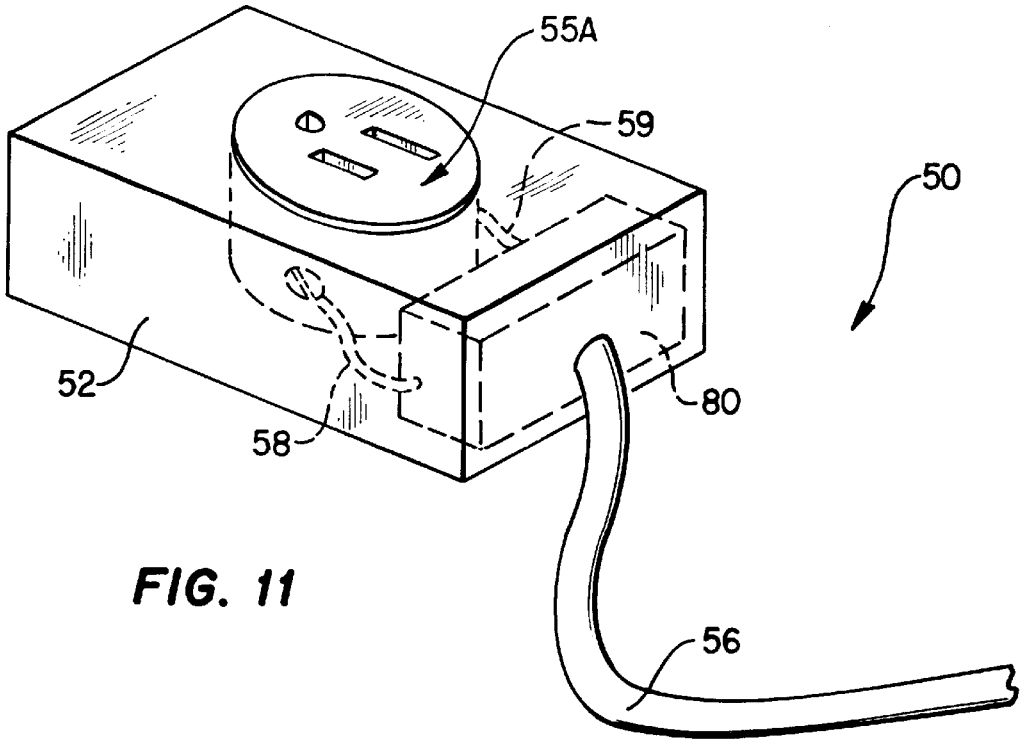
FIG. 11 is a perspective view of the external source adapter for the second embodiment apparatus showing the external source adapter having a type of extension coupling component with contacts adapted to receive and couple to contacts at another plug end of the extension cord(s).

Alternatively, in FIGS. 3 and 9, another type of extension attaching component 36B or 37B of the power tool adapter 30 is coupled to the power coupling contacts 38 and 39. The contacts of the extension attaching component 36B or 37B are located at the bottom portion 33 of the housing 32 and are accessible via generally through the access or open area 35 of the housing 32 and through an access or open area of the door 24 (i.e. not shown) of the power tool 20. A plug of the extension cord 40 is directly attached to the extension attaching component 36B or 37B located at the bottom portion 33 of the housing 32. FIG. 3 shows that the extension attaching component 36B is a female plug 36B with receiving contacts that receive a male plug 42 from an extension cord 40 while FIG. 9 shows that the extension attaching component 37B is a male plug 37B with inserting contacts that insert into a female plug 44 of an extension cord 40.

The female extension attaching component 36A of FIGS. 1, 2, and 4 and 36B of FIG. 3 have the advantage of preventing the power tool adapter or coupler 30 from being accidentally inserted into inappropriate plug receptacles (i.e. such as a 110 Volt AC receptacle). In FIGS. 1, 2, and 3 or FIGS. 7, 8, and 9, a safety trip mechanism or fuse 70 is shown coupled between the power coupling contact 38 and the extension attaching component 36A, 36B, 37A, or 37B to prevent damage to the power tool adapter 30 and the power tool 20 and/or prevent injury to a user in an event of a power overload or a power surge that is applied through the extension attaching component 36A, 36B, 37A, or 37B. The safety mechanism 70 trips or the fuse 70 (i.e. which include but are not limited to a circuit breaker or fuse circuit) blows when a power overload or power surge occurs. Access portion 72 allows the safety mechanism 70 to be reset or the fuse 70 to be replaced by the user in the event that a power overload or power surge occurs.

A male plug end 42 (i.e. in FIG. 1) or a female plug end 44 (i.e. in FIG. 7) of the extension cord(s) 40 is respectively coupled to the one type of extension attaching component 36A or 37A of the power source adapter or coupler 30. A number of or multiple extension cords 40 is/are coupled together so that a desired length of cord is provided to the user of the power tool 20. Alternatively, a male plug end 42 or female plug end 44 of the extension cord(s) 40 is respectively coupled to the other type of extension attaching component 36B (i.e. FIG. 3) or 37B (i.e. FIG. 9) of the power source adapter or coupler 30. Correspondingly, the other end of the extension cord(s) 40, which is a female plug end 44 (i.e. for the first embodiment of FIG. 1 or FIG. 3) or male plug end 42 (i.e. for the second embodiment of FIG. 7 or FIG. 9), is coupled to the external source adapter or coupler 50.

Referring to FIGS. 1 and 5 and FIGS. 7 and 12, an external source adapter 50 has one type of an extension coupling component 54A or 55A with contacts adapted to receive and couple to contacts at a respective female plug end 44 (i.e. for the first embodiment of FIG. 1) or male plug end 42 (i.e. for the second embodiment of FIG. 7) on the at least one extension cord 40. In these figures, the external source adapter 50 has a receptacle housing or box 52 that generally holds the one type of extension coupling component 54A or 55A. The extension coupling component 54A or 55A has extension cord contacts, and these extension cord contacts are located in the housing 52.

The housing or box 52 has an access or open area 52A for holding the one type of extension coupling component 54A or 55A therein and for allowing the extension coupling component 54A or 55A with its extension cord contacts to be accessed in order to couple to a respective plug end 44 or 42 of the extension cord(s) 40. Another access or open area 52B is located at an end of the housing or box 52. A cord 56 couples from the extension coupling component 54A or 55A within the housing 52, through the access or open area 52B to the outside of the housing or box 52, and to the external source coupling component 55. The cord 56, therefore, is located between and couples the one type of extension coupling component 54A or 55A and the external power source contacts 58 and 59 of the external source coupling component 55 via respective coupling wires 51 and 53 within the cord 56. The external source coupling component 55 has external power source contacts 58 and 59, and these external power source contacts 58 and 59 respectively couple to terminals 98 and 99 of the external direct current power source 90. In FIGS. 1 and 7, the external power source contacts are shown as alligator clips that are able to clamp onto the terminals 98 and 99 of the external direct current power source 90.

Figure 6:
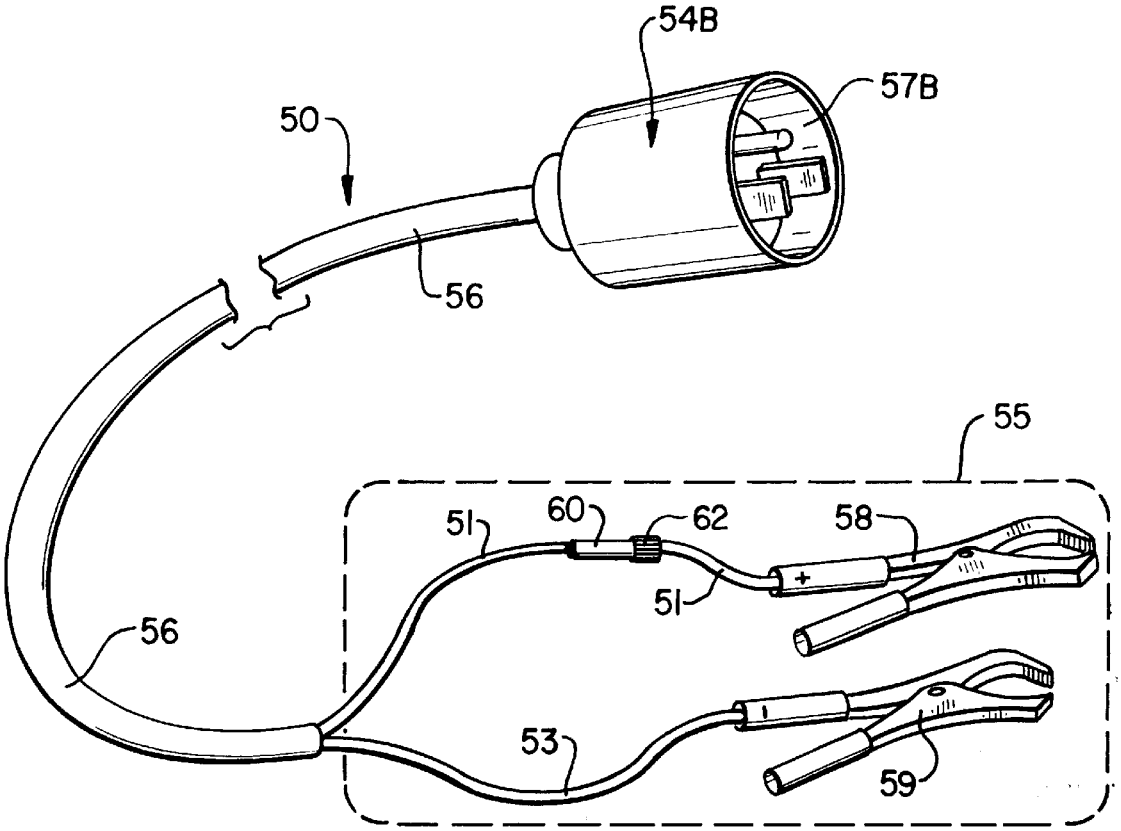
FIG. 6 is a perspective view of the external source adapter for the first embodiment apparatus showing the external source adapter having another type of extension coupling component with contacts adapted to receive and couple to contacts at another plug end of the extension cord(s).
Figure 12:
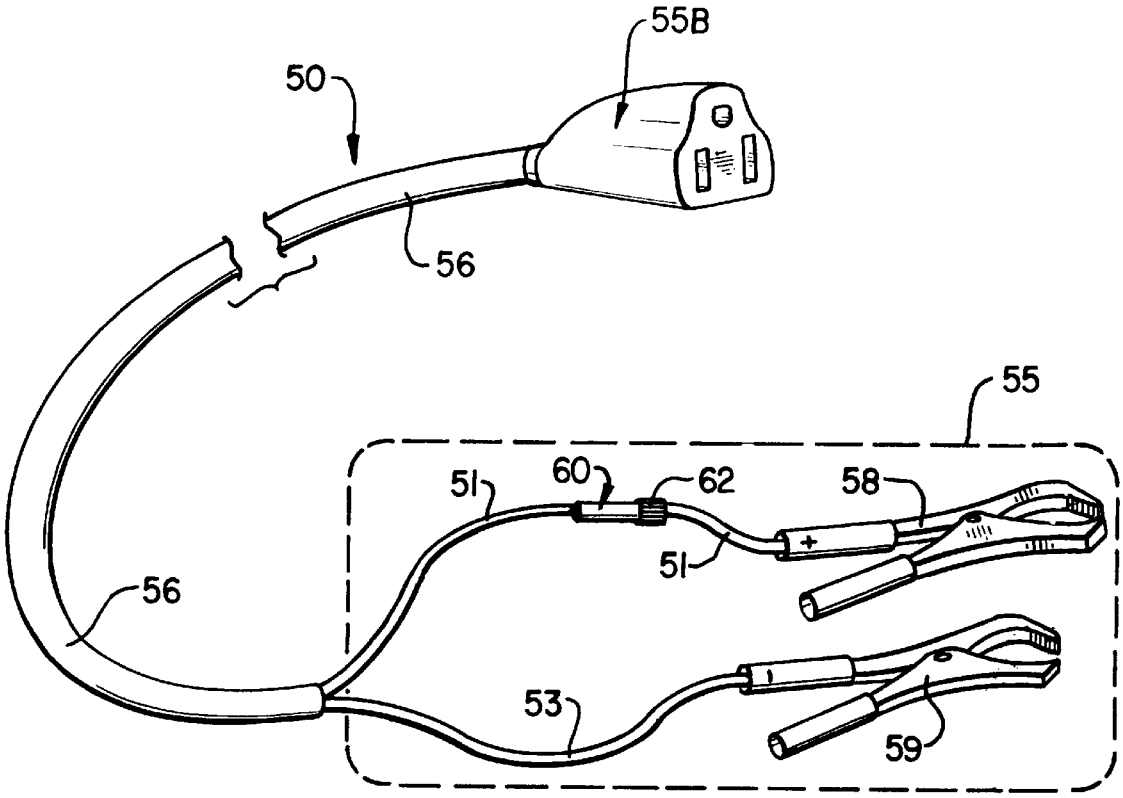
FIG. 12 is a perspective view of the external source adapter for the second embodiment apparatus showing the external source adapter having another type of extension coupling component with contacts adapted to receive and couple to contacts at another plug end of the extension cord(s).

Alternatively, in FIGS. 6 and 12, another type of extension coupling component 54B or 55B of the external source adapter 50 is used to receive and couple to contacts at a respective female plug end 44 (i.e. for the first embodiment of FIG. 6) or male plug end 42 (i.e. for the second embodiment of FIG. 12) on the at least one extension cord 40. This other type of extension coupling component 54B or 55B are simply plugs that are able to receive and couple to respective female plug end 44 or male plug end 42. The cord 56 couples from the extension coupling component 54B or 55B to the external source coupling component 55. The cord 56, therefore, is located between and couples the extension coupling component 54B or 55B and the external power source contacts 58 and 59 of the external source coupling component 55 via respective coupling wires 51 and 53 within the cord 56. The external source coupling component 55 has external power source contacts 58 and 59, and these external power source contacts 58 and 59 respectively couple to terminals 98 and 99 of the external direct current power source 90. In FIGS. 6 and 12, the external power source contacts are also shown as alligator clips that are able to clamp onto the terminals 98 and 99 of the external direct current power source 90.

Figure 5:
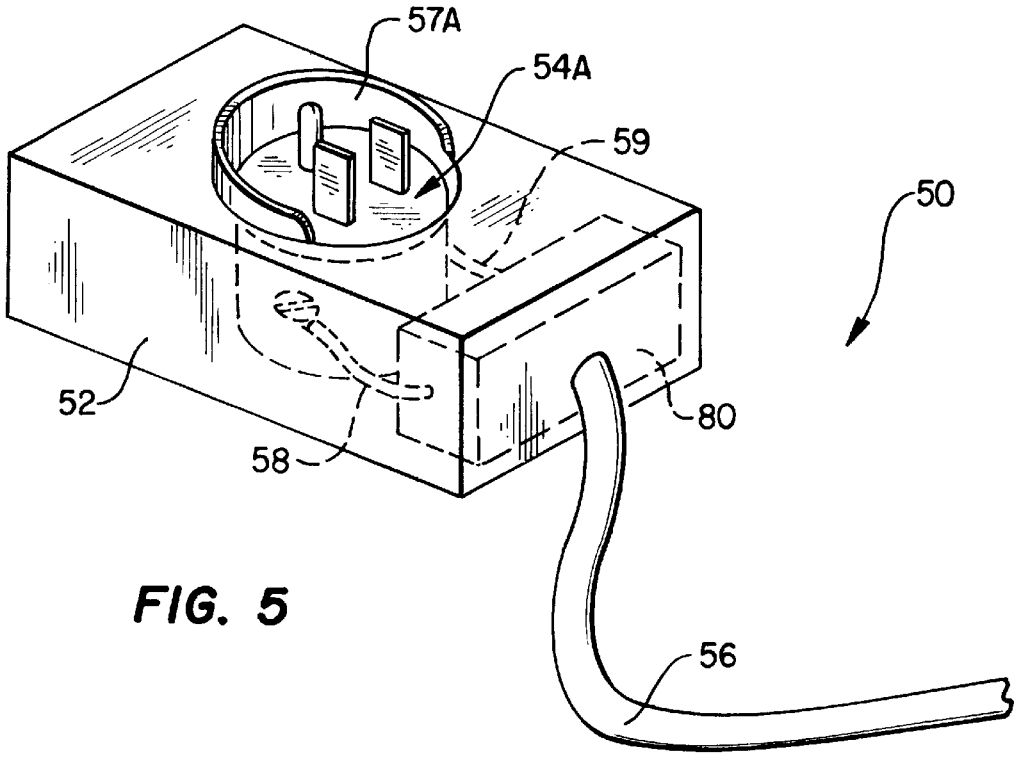
FIG. 5 is a perspective view of the external source adapter for the first embodiment apparatus showing the external source adapter having a type of extension coupling component with contacts adapted to receive and couple to contacts at another plug end of the extension cord(s).

The male extension coupling component 54A of FIG. 1 and FIG. 5 and 54B of FIG. 6 show a respective guard component 57A or 57B surrounding the male component 54A or 54B to prevent and block the plug contacts of the male component 54A or 54B from being accidentally inserted into inappropriate plug receptacles (i.e. such as a 110 Volt AC wall or building receptacle). The guard component 57A or 57B has an equal or larger height than the plug contacts of the male component 54A or 54B which prevents the plug contacts from being inserted into a receptacle located in a planar surface or wall since the guard component 54A or 54B contacts the planar surface or wall and the plug contacts of the male component 54A or 54B are not able to contact the planar surface/wall or receptacle. Furthermore, the plug contacts of the male component 54A or 54B may be recessed into the housing or box 52 to also aid in preventing the plug contacts from being inserted into inappropriate receptacles.

In FIGS. 1 and 6 or FIGS. 7 and 12, a safety trip mechanism or fuse 60 is coupled in line with the wire 51 of cord 56 so that it is coupled between the external power source contact 58 and the extension coupling component 54A, 54B, 55A, or 55B to prevent damage to the external source adapter 50 and the power tool 20 and/or prevent injury to a user in an event of a power overload or a power surge applied from the external power source contact 58. The safety mechanism 60 trips or the fuse 60 (i.e. which include but are not limited to a circuit breaker or fuse circuit) blows when a power overload or power surge occurs. Access portion 62 allows the safety mechanism 60 to be reset or the fuse 60 to be replaced by the user in the event that a power overload or power surge occurs.

Furthermore, in FIGS. 1 and 5 or FIGS. 7 and 11, the external source adapter 50 further has a voltage regulator circuit 80 that regulates and controls voltage coming from the external direct current power source 90 that, in turn, is used to operate the power tool 20. The voltage regulator circuit 80 is coupled between the extension coupling component 54A or 55A and the external source coupling component 55. The voltage regulator circuit 80 may be adjusted either automatically or manually by the user to the appropriate voltage level for operating the power tool 20. Various power tools 20 operate at different voltage levels, and therefore, the voltage regulator circuit 80 allows the control and regulation of the appropriate voltage level or voltage amount to be provided to the power tool 20 for operation of the tool 20.

The present invention which couples the power tool 20 to an external DC power source 90 shows that the appropriate polarity is maintained to properly operate the power tool 20. FIGS. 4 and 10 show the power tool contact 28 is the positive polarity power tool contact while the power tool contact 29 is the negative power tool polarity contact. Positive power tool contact 28 couples to positive power coupling contact 38, and negative power tool contact 29 couples to the negative power coupling contact 39. The polarity is maintained through the various cords, plugs, and receptacles having a respective set of inner wires and contacts that couple together to provide the positive polarity and having another respective set of inner wires and contacts that couple together to provide the negative polarity. Polarized plugs and receptacles (i.e. one set of plugs/receptacle leads corresponds to the positive polarity and the other set of plugs/receptacle leads corresponds to the negative polarity) may be used in conjunction with the present invention. The polarized plugs and receptacles are designed so that they are able to couple to a presently existing or conventional extension cord 40. The positive set of wires and contacts couple to the wire 51 of the external source adapter 50. The wire 51 is coupled to the positive external power source contact 58, and the external power source contact 58 clips or attaches to the positive terminal 98 of the external power source 90. The negative set of wires and contacts couple to the wire 53 of the external source adapter 50. The wire 53 is coupled to the negative external power source contact 59, and the external power source contact 59 clips or attaches to the negative terminal 99 of the external power source 90.

The present invention is used by coupling a power tool 20, that normally operates by an internal direct current power source, to an external direct current power source 90. The user respectively couples contacts 28 and 29 of the power tool 20 to contacts 38 and 39 of a power tool coupling device 32. The contacts 38 and 39 are coupled to an extension cord coupler 36A, 36B, 37A, or 37B. The extension cord coupler 36A, 36B, 37A, or 37B is coupled to a respective plug end 42 or 44 of an extension cord 40. The other respective plug end 44 or 42 of the extension cord(s) 40 is coupled to contacts of an external power source coupling device 54A, 54B, 55A, or 55B. The contacts of the external power source coupling device 54A, 54B, 55A, or 55B are coupled to external power source couplers 58 and 59, and the external power source couplers 58 and 59 are coupled to the external direct current power source 90. The external direct current power source 90 provides the power to the tool 20 so that the user may operate the tool 20.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application, and to enable others skilled in the art to best utilize the invention in various embodiments and with various modifications as are suited to the particular use contemplated.

What is claimed is:

1. An apparatus for using at least one standard alternating current extension cord to couple a direct current power tool having power tool contacts, which normally couple to an internal direct current power source for normal operations of the power tool, to an external direct current power source comprising:

a power tool adapter having power coupling contacts that are able to correspondingly couple to the power tool contacts of the direct current power tool and further having an extension attaching component with contacts that are coupled to the power coupling contacts and that are adapted to receive a plug end of the at least one standard alternating current extension cord and couple to contacts at the plug end, an external source adapter having an extension coupling component with contacts adapted to receive another plug end of the at least one standard alternating current extension cord and couple to contacts at the another plug end and having external power source contacts coupled to the contacts of the extension coupling component and adapted to couple to contacts of the external direct current power source, wherein the external source adapter further comprises a voltage regulator circuit coupled between the extension coupling component and the external power source contacts to regulate and control voltage from the external direct current power source.

2. The apparatus according to claim 1 wherein the power tool adapter further comprises:

a tool adapter housing that generally holds the power coupling contacts and to which the extension attaching component is attached wherein the housing is conformed to slidingly insert into a power source receptacle of the power tool and wherein the housing has at least one access area through which the power coupling contacts are able to couple to the power tool contacts and another at least one access area through which the extension attaching component is able to receive and couple to the plug end of the at least one standard alternating current extension cord.

3. The apparatus according to claim 2 wherein the tool adapter housing is a battery cartridge housing that is slidingly insertable into a battery cartridge receptacle of the direct current power tool.

4. The apparatus according to claim 1 wherein the power tool adapter further comprises:

at least one cord coupled between the power coupling contacts and the extension attaching component.

5. The apparatus according to claim 1:

wherein the power tool contacts comprises at least two power tool contacts, and wherein the power coupling contacts comprises at least two power coupling contacts.

6. The apparatus according to claim 5:

wherein the at least two power tool contacts comprises a positive power tool contact and a negative power tool contact, wherein the at least two power coupling contacts comprises a positive power coupling contact and a negative power coupling contact, and wherein the positive power tool contact couples to the positive power coupling contact and the negative power tool contact couples to the negative power coupling contact.

7. The apparatus according to claim 1 further comprising:

a safety trip mechanism coupled between the power coupling contacts and the extension attaching component to prevent damage to the power tool adapter and the direct current power tool in an event of a power overload applied through the extension attaching component.

8. The apparatus according to claim 1 wherein the extension attaching component with contacts is a female plug with plug receiving contacts that is adapted to receive and couple to a male plug end of the at least one standard alternating current extension cord.

9. The apparatus according to claim 1 wherein the at least one standard alternating current extension cord is a multiple number of standard alternating current extension cords coupled together.

10. The apparatus according to claim 1 wherein the external source adapter further comprises:

an external source adapter housing that generally holds the extension coupling component and to which one end of the external power source contacts are attached wherein the housing has at least one access area for allowing the extension coupling component to be accessed to couple to the another plug end of the at least one standard alternating current extension cord and another at least one access area through which another end of the external power source contacts are able to couple between the extension coupling component and the external direct current power source.

11. The apparatus according to claim 10 wherein the external source adapter housing is a receptacle box housing that holds the extension coupling component adapted to receive and couple to the contacts of the another plug end of the at least one standard alternating current extension cord and that couples to and holds the one end of the external power source contacts.

12. The apparatus according to claim 1 wherein the external source adapter further comprises:

at least one cord coupled between the extension coupling component and the external power source contacts.

13. The apparatus according to claim 1:

wherein the contacts of the extension coupling component comprises at least two extension coupling component contacts, and wherein the external power source contacts comprises at least two external power source contacts.

14. The apparatus according to claim 13:

wherein the at least two contacts of the extension coupling component comprises a positive extension coupling contact and a negative extension coupling contact, wherein the at least two external power source contacts comprises a positive external power source contact and a negative external power source contact, and wherein the positive power extension coupling contact couples to the positive external power source contact and the negative power extension coupling contact couples to the negative external power source contact.

15. The apparatus according to claim 1 further comprising:

a safety trip mechanism coupled between the extension coupling component and the external power source contacts to prevent damage to the extension coupling component and the direct current power tool in an event of a power overload from the at least one standard alternating current extension cord.

16. The apparatus according to claim 1 wherein the extension coupling component with contacts is a male plug component with plug inserts that is adapted to insert and couple to a female plug end of the at least one standard alternating current extension cord.

17. The apparatus according to claim 16 wherein the extension coupling component further comprises:

a guard component surrounding the male plug component to guard the male plug from being accidentally inserted into inappropriate plug receptacles.

18. The apparatus according to claim 1 wherein the external power source contacts are alligator clips for coupling to terminals of the external direct current power source.

* * * * *